US005389765A

United States Patent [19]

Baer

[11] Patent Number: 5,389,765

[45] Date of Patent: Feb. 14, 1995

[54] ARRANGEMENT FOR SEVERING THE TENSION MEMBER OF A SOIL ANCHOR AT A PREDETERMINED LOCATION BY INDUCTION HEATING

[75] Inventor: Toni Baer, Schwanden, Switzerland

[73] Assignee: Dyckerhoff & Widmann Aktiengesellschaft, Munich, Germany

[21] Appl. No.: 108,080

[22] Filed: Aug. 17, 1993

[30] Foreign Application Priority Data

Aug. 17, 1992 [CH] Switzerland ..... 2555/92

[51] Int. Cl.[6] ..... H05B 6/10

[52] U.S. Cl. ..... 219/635; 219/637; 219/670; 219/618; 83/16

[58] Field of Search ..... 219/637, 643, 635, 602, 219/644, 670, 618, 634; 83/15, 16, 170

[56] References Cited

U.S. PATENT DOCUMENTS

| | | | |
|---|---|---|---|
| 2,178,720 | 11/1939 | Daniels | 219/637 |
| 2,948,797 | 8/1960 | Kurtz | 219/643 |
| 4,007,349 | 2/1977 | Burley | 219/645 |
| 4,916,278 | 4/1990 | Rudd et al. | 219/646 |
| 5,075,529 | 12/1991 | Kudo | 219/635 |

FOREIGN PATENT DOCUMENTS

| | | |
|---|---|---|
| 2274740 | 1/1976 | France . |
| 2428729 | 12/1975 | Germany . |
| 603919 | 8/1978 | Switzerland . |

*Primary Examiner*—Philip H. Leung
*Attorney, Agent, or Firm*—Friedrich Kueffner

[57] ABSTRACT

An arrangement for severing a tension member of a permanent soil anchor of ferromagnetic material at a predetermined location includes a coil surrounding the tension member in a tubular manner at the predetermined location, wherein the coil is mountable together with the tension mender. A high temperature-resistant thermal insulation layer is provided underneath the coil and a tubular core is arranged between the high temperature-resistant layer and the tension member, so that the coil forms a primary winding and the core forms a first secondary winding and the tension member forms a second secondary winding. The tension member is severed by applying an electric current having a frequency of approximately 5 to 30 kHz and a voltage of approximately 500 to 800 V to the coil, so that the tensile strength of the tension member is reduced at the predetermined breaking point by the heat produced by induction resulting from the electric current.

4 Claims, 2 Drawing Sheets

ARRANGEMENT FOR SEVERING THE TENSION MEMBER OF A SOIL ANCHOR AT A PREDETERMINED LOCATION BY INDUCTION HEATING

BACKGROUND OF THE INVENTION

1. Field of the Invention

The present invention relates to an arrangement for severing or cutting a tension member of a soil anchor composed of ferromagnetic material at a predetermined location thereof. The tension member is provided with a predetermined breaking point by reducing its tensile strength. The arrangement includes a coil which can be placed or mounted in a bore hole together with the tension member and surrounds the tension member in a tubular manner at the intended severing point. Electric current can be applied to the coil for producing a predetermined breaking point by reducing the tensile strength of the tension member as a result of thermal influence due to induction.

2. Description of the Related Art

A soil anchor includes a tension member which is introduced into a bore hole opening and a bonding action is obtained with the bore hole wall and, thus, with the surrounding soil, by pressing in hardening material, such as, cement, mortar or the like. This produces a pressing body which is connected in a frictionally engaging manner with the structural component to be anchored through the remaining part of the tension member which extends to the bore hole opening. The tension member may be composed of a single element or of several elements which, in turn, may be composed of steel rods, steel wires, steel strands or even steel pipes. The length of the tension member over which the tension member is embedded in the pressing body is called the anchoring length, and the remaining length of the tension member, which for the purposes of prestressing is freely extendable, is called the free steel length.

Soil anchors may be used for the permanent anchoring of structures in the soil. However, they can also be used temporarily, such as, for the rearward anchoring of a wall in an excavation. If a temporarily mounted soil anchor extends into a neighboring piece of land, it must usually be removed after the construction work during which it was employed has ended.

For removing a soil anchor, a possibility for severing the tension member is provided usually at the transition between the anchoring length and the free steel length of the tension member, so that the free part of the tension member can be pulled out of the bore hole and possibly recovered. The pressing body itself, which rarely has a length greater than about four to eight meters, can usually be easily removed if excavation work in the neighboring piece of land is carried out over the surface area thereof, for example, by means of bulldozers.

Of the various possibilities for severing the tension member of a permanent soil anchor, the use of heat for reducing the strength of the steel tension member is most important because the means required for producing the heat can be mounted together with the tension member without significantly enlarging the bore hole diameter and can be kept operational over a longer period of time. In addition, if for severing the tension member a predetermined breaking point is provided by reducing its strength by means of thermal influence, the tension member can be utilized with its full cross-section during the entire duration of its use.

For producing the heat necessary for reducing the tensile strength of the tension member, it is known in the art to heat the tension member in the area of the predetermined breaking point by means of an exothermic reaction, for example, an aluminothermic mixture (FR 22 74 740). In order to release the exothermic reaction, an ignition system is required which is difficult to maintain capable of ignition in the mounted state of the anchor, wherein the mounted state may extend over a long period of time.

It is also known in the art to use electrical energy for producing heat. This can be effected by means of an electric heating element, for example, in the form of a heating coil surrounding the tension member (DE 24 28 729 C3), or also by means of a coil which surrounds the tension member at the severing point and which is supplied with electric current in order to produce heat through induction in the tension member or tension members (CH 603 919). It has been found that, even when thermal insulation layers were arranged, it was not possible to achieve a temperature sufficient for reliably severing the tension member because a large portion of the supplied heat is lost through thermal conduction through the tension member itself.

SUMMARY OF THE INVENTION

Therefore, in view of the disadvantages of the known arrangements of the above-described type, it is a primary object of the present invention to make it possible by the use of electrical energy in the shortest possible time in the steel tension member to provide at the predetermined severing point such a high temperature level that the separation takes place reliably and completely, and that the free steel length can be pulled out without problems from the bore hole.

In accordance with the present invention, the coil which surrounds the tension member at the predetermined severing point is arranged as a primary winding on a high temperature-resistant thermal insulation layer, and the thermal insulation layer, in turn, is arranged on a tubular core of electrically conducting, heat-resistant and ferromagnetic material, wherein the core forms a first secondary winding and the tension member forms a second secondary winding, wherein, for severing the tension member, electric energy having a frequency of approximately 5 to 30 kHz and a voltage of approximately 500 to 800 V can be applied to the coil.

The present invention is based on the finding that, by the use of induction a frequency range which permits a transmission of the electric energy through a commercially available feed cable, it is only possible to heat the tension member up to Curie temperature because the ferromagnetic material of the tension member, i.e., the steel, subsequently becomes paramagnetic and, therefore, permits a further energy supply by induction only to a very limited extent. Accordingly, the basic concept of the present invention resides in that, for heating above the Curie temperature, if possible, up to the melting point, an additional possibility must be found. In accordance with the present invention, this possibility is the arrangement of a tubular core of electrically conductive, heat-resistant and paramagnetic material, preferably of austenitic steel, between the primary winding and the steel tension member to be severed.

In accordance with the present invention, the transfer of power according to the induction principle takes place essentially in two phases:

up to Curie temperature, i.e., the temperature at which the steel tension member changes from the ferromagnetic range to the paramagnetic range, the steel tension member is heated because of the depth of penetration of the current induced into the steel tension member and because of the magnetic losses due to the direct radial current flow and because of a heat supply from the tubular core;

above the Curie temperature up to the melting temperature of the steel tension member, heat conduction and heat radiation of the tubular core are predominantly effective for achieving the additional rise of the temperature in the steel tension member.

In the first phase, the middle-frequency electric current of five to thirty kHz, which is produced by means of suitable units and can be transported to the intended severing point over lengths of up to about 50 meters still without significant losses, produces eddy currents in the tension member which is to be severed and acts as a short-circuited secondary winding. These eddy currents uniformly heat the entire cross-section of the tension member. It is not significant in this connection whether the inside cross-section of the tubular core is completely or only partially filled by the material of the tension member or whether the tension member is entirely or only at certain locations in thermally conducting connection with the tubular core. Depending on the existing conditions, any intermediate spaces can be filled out by a gaseous medium, for example, air, a liquid medium, for example, water, or a solid medium, for example, cement, mortar, plastics material. In any event, the penetration depth of the electric current should be selected in such a way that it reaches approximately to the center of the inside cross-section of the tubular core, independently of where the tension member or tension members are present within this cross-section.

During this phase, the tubular core which is composed of paramagnetic material and facilitates passage of the electrical energy to the tension member, also acts as a short-circuited secondary winding which is heated as a result of its electrical conductivity. Since, during this phase, a very high temperature gradient exists, the heat can be discharged radially inwardly, i.e., toward the tension member. The high temperature-resistant thermal insulation layer between the tubular core and the primary winding prevents heat from being conducted away radially outwardly.

In the second phase, i.e., after reaching the Curie temperature, electrical energy is still supplied to the same extent. Since the tension member has in this phase substantially reduced ferromagnetic properties, the proportion of induction is limited, so that only very little energy is absorbed. The electrical energy still available in this phase is converted as a result of the transformer effect into heat almost exclusively in the tubular core. By heat conduction and heat radiation, this heat is then transferred to the tension member, so that the melting point can be reached within the service life of the coil.

The temperature level required for severing the steel tension member depends on the material properties of the tension member, on the one hand, and, on the other hand, on the stress or elongation conditions present in the tension member due to existing or applied tensile forces and on the size of the freely movable or the freely extendable partial lengths of the tension member. A medium possibly filling out intermediate spaces between the individual elements of the tension member is virtually without influence below the Curie temperature on the rate of the temperature rise depending on the proportion of the cross-sectional surface, and the influence above the Curie temperature is only slight and occurs only if the medium is present in the solid state and constitutes a large portion of the cross-sectional area.

Critical situations in the use of the arrangement according to the present invention with respect to existing mechanical tensile stress are the case of an untensioned steel tension member which must be virtually melted through for severing and the case of a steel tension member which is tensioned up to failure purely mechanically and which will fail at some point without heating in the area of the free steel length.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENTS

Figure 1:
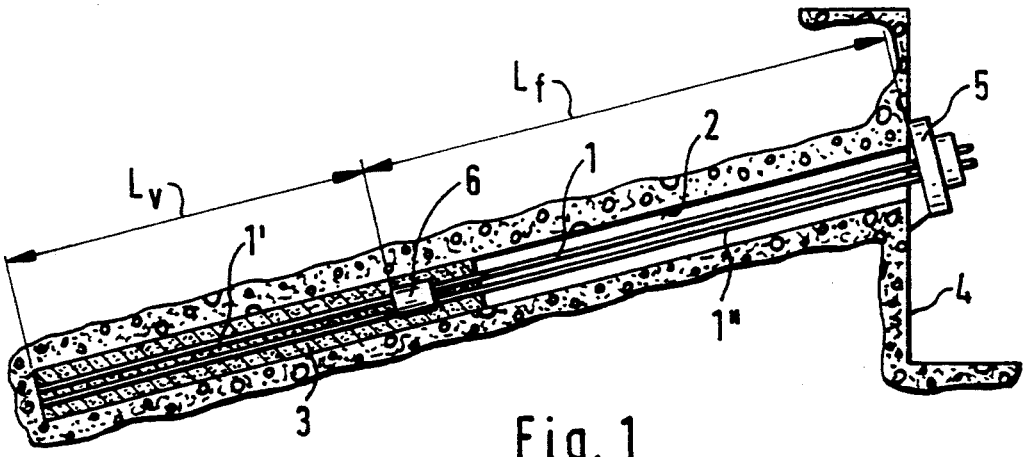
FIG. 1 is a schematic longitudinal sectional view of a permanent soil anchor.

FIG. 1 of the drawing is a longitudinal sectional view of a permanent soil anchor which includes a steel tension member 1, for example, a bundle of steel wire strands. The steel tension member 1 is inserted in a bore hole 2. A pressing body 3 is produced in the lower portion of the bore hole 2 by pressing in hardening material, for example, cement mortar. The tension member 1 is anchored in the pressing body 3 over a portion 1' of its entire length, the so-called anchoring length $L_v$. Over the remaining portion 1'' of its entire length, the so-called free steel length $L_f$, the tension member 1 is freely extendable. At the opening of the bore hole 2, the tension member 1 is anchored by means of an anchoring system 5, for example, for securing an excavation wall 4. The present invention is not directed to the anchoring system 5.

An arrangement 6 for producing a predetermined breaking point by applying a thermal influence is arranged in the region of the transition from the anchoring length $L_v$ to the free steel length $L_f$. The tension member 1 can be severed at this predetermined breaking point, so that the portion 1'' extending over the free steel length $L_f$ can be pulled out of the bore hole 2. The arrangement 6 may either be located in the free portion 1'' of the tension member 1, i.e., outside of the pressing body 3, but the arrangement 6 can also be embedded, as illustrated in the drawing, in the pressing body 3.

If the portion 1' of the tension member 1 extending over the anchoring length $L_v$ is also to be removed, this portion 1' can be guided longitudinally movably through the pressing body 3 and can be anchored at the lower end by means of suitable anchoring systems, for example, a pipe subjected to compressive load. In this case, the arrangement 6 is provided at the lower end of the tension member 1.

Figure 2:
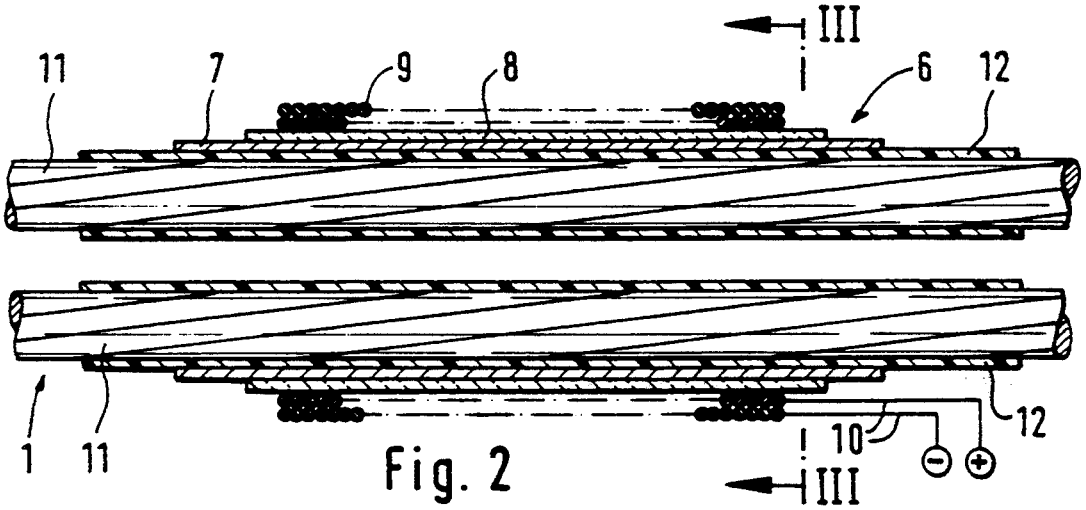
FIG. 2 is a longitudinal sectional view, on a larger scale, of an arrangement for forming a predetermined breaking point according to the present invention.
Figure 3:
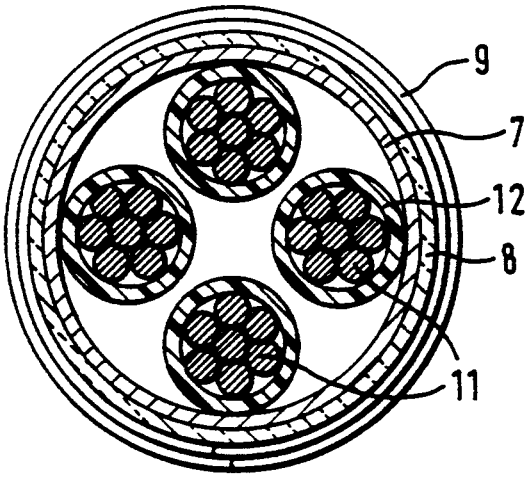
FIG. 3 is a cross-sectional view taken along line III—III of FIG. 2.
Figure 4:
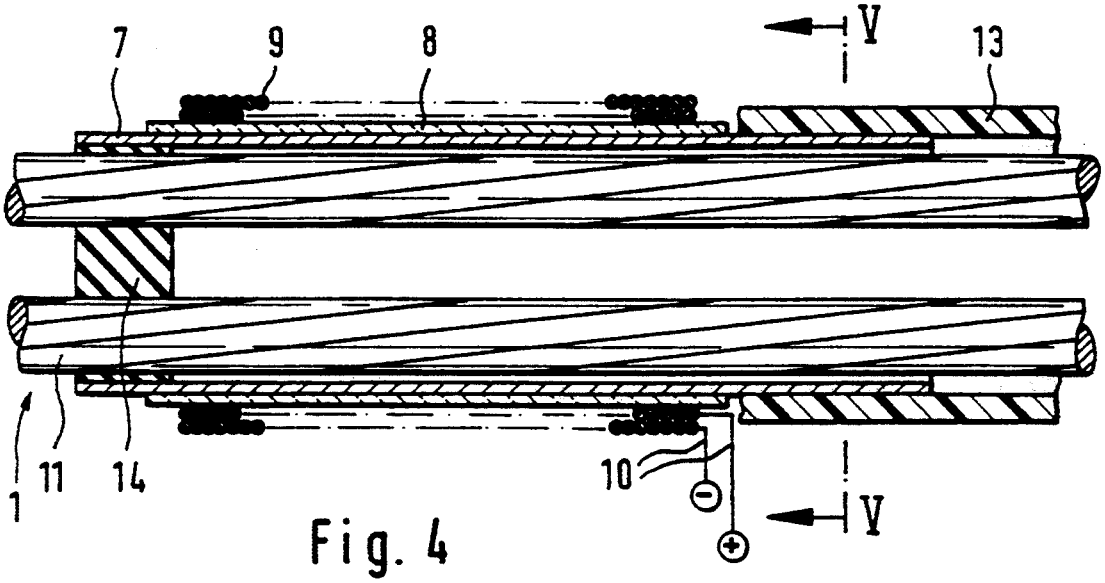
FIG. 4 is a longitudinal sectional view of another embodiment of the arrangement of FIG. 2.
Figure 5:
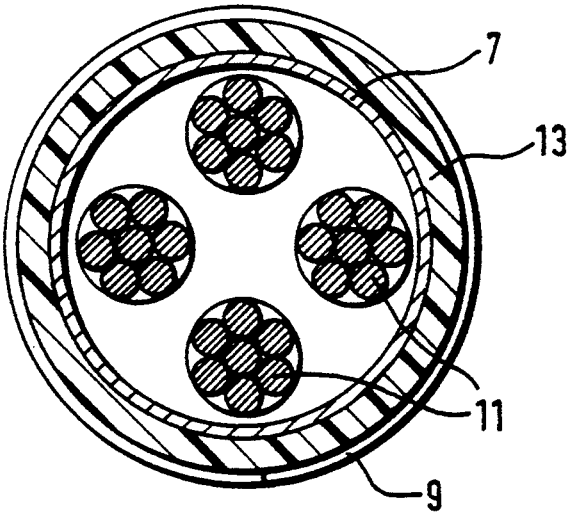
FIG. 5 is a cross-sectional view taken along sectional line V—V in FIG. 4.

An embodiment of the arrangement 6 according to the present invention for producing a predetermined breaking point is shown on a larger scale in FIGS. 2 and 3 in longitudinal and transverse sectional views. In the illustrated embodiment, the arrangement 6 has the form of an annular sleeve which can be slid onto the tension member 1 prior to being mounted in the bore hole 2. The arrangement 6 is composed from the inside to the outside of a tubular core of austenitic steel, i.e., the so-called carrier pipe 7 and a high temperature-resistant thermal insulation layer 8 mounted on the carrier pipe 7. Arranged on the thermal insulation 8 are the windings of a coil 9 which acts as the primary winding of a transformer. The coil 9 is preferably composed of an even number of layers, for example, of two layers, so that the two phases of a supply line 10 can be conducted on the same side of the coil 9 to the anchoring system 5. The windings of the coil 9 are insulated so as to be high temperature-resistant, for example, by initially covering them by means of a thermal lacquer and subsequently spinning glass fibers around the windings.

In the illustrated embodiment, the tension member 1 is composed of a bundle of seven individual steel wire strands 11 which, in the area of the anchoring length $L_v$ are embedded directly in the pressing body 3 and, in the area of the free steel length $L_f$, are individually surrounded by protective pipes 12 of plastics material, for example, PE. In order to secure the strands in their position and also for protecting them against any water which may penetrate, the intermediate spaces between the individual strands 11 and the inner wall of the carrier pipe 7 can be filled out, for example, with polyurethane foam.

Another embodiment of the arrangement according to the present invention is illustrated in FIG. 1. While the configuration of the arrangement 6 itself corresponds to that described in connection with FIG. 2, the individual strands 11 of the tension member 1 are in this case arranged in the area of the free steel length $L_f$ within a single protective pipe 13. The hardening material pressed in for producing the pressing body 3 is prevented by a sealing member 14 from penetrating the interior of the protective pipe 13.

For severing the tension member 1, an electric current having a frequency of approximately 5 to 30 kHz and a voltage of approximately 500 to 800 V is applied to the coil 9 through the supply line 10. The electrical energy may be made available through a unit for producing electrical energy of a high frequency and supplied through a feed cable. Depending on the depth of penetration of the current induced in the tension member 1, eddy currents are induced in the tension member 1 or in its individual elements. Until the Curie temperature is reached, these eddy currents lead to a relatively rapid heating of the tension member 1. During this period, the carrier pipe 7 of austenitic steel acts as a short-circuited winding, similar to the tension member 1 itself, and is also heated. Because a high temperature gradient exists in this initial phase, a high proportion of heat is transferred into the interior toward the tension member 1. Because of the high temperature resistant thermal insulation, only very little heat can flow toward the outside. Since the carrier pipe 7 has in this temperature range a lower temperature increase gradient than the tension member 1, this simultaneously ensures a thermal and mechanical protection of the coil 9.

After reaching the Curie temperature, the steel of the tension member 1 substantially loses its ferromagnetic properties and has an essentially paramagnetic behavior. Since electrical energy continues to be supplied, but the tension member 1 only uses very little energy, a greater electrical power than previously is available for heating the carrier pipe 7 which still acts as a secondary coil. In this manner, heating of the tension member can be carried out essentially up to the melting point. The extent to which the reduction of the strength of the tension member must be carried out depends on the stress or elongation still existing in the tension member 1. If the tension member is still tensioned at the time of severing, a lower temperature is sufficient for severing than in those cases in which the tension member has only a low tension or is entirely without tension.

The arrangement 6 according to the present invention has the additional advantage that the operativeness of the arrangement 6 and of the electrical feed cable can be tested at any time by means of the usual electrical measuring methods. The arrangement 6 can only be actuated by an appropriate electrical unit producing higher frequencies. Any unwanted or unauthorized actuation of the arrangement, for example, through foreign energy sources, such as lightening, can be excluded.

The invention is not limited by the embodiments described above which are presented as examples only but can be modified in various ways within the scope of protection defined by the appended patent claims.

I claim:

1. An arrangement for severing a tension member of soil anchor of ferromagnetic material at a predetermined location forming a predetermined breaking point, the apparatus comprising a coil surrounding the tension member in a tubular manner at the predetermined breaking point and being mountable together with the tension member, a high temperature-resistant thermal insulating layer underneath the coil, a tubular core of electrically conducting, heat-resistant and ferromagnetic material, the tubular core being arranged between the high temperature-resistant layer and the tension member, such that the coil forms a primary winding and the core forms a first secondary winding and the tension member forms a second secondary winding, and means for applying an electric current having a frequency of approximately 5 to 30 kHz and a voltage of approximately 500 to 800 V to the coil for reducing the tensile strength of the tension member at the predetermined breaking point by means of heat produced by induction resulting from the electric current.

2. The arrangement according to claim 1, wherein the tubular core is of austenitic steel.

3. The arrangement according to claim 1, wherein the coil has an even number of winding layers.

4. A method of severing a tension member of a permanent soil anchor of ferromagnetic material at a predetermined location forming a predetermined breaking point, the method comprising mounting a coil around the tension member in a tubular manner at the predetermined breaking point, wherein the coil is mountable together with the tension member, mounting a high temperature-resistant thermal insulating layer underneath the coil and a tubular core of electrically conducting, heat-resistant and ferromagnetic material between the high temperature-resistant layer and the tension member, such that the coil forms a primary winding and the core forms a first secondary winding and the tension member forms a second secondary winding, further comprising applying an electric current having a frequency of approximately 5 to 30 kHz and a voltage of approximately 500 to 800 V to the coil for reducing the tensile strength of the tension member at the predetermined breaking point by means of heat produced by induction resulting from the electric current.

* * * * *